US008215735B2

(12) United States Patent
Tang

(10) Patent No.: US 8,215,735 B2
(45) Date of Patent: Jul. 10, 2012

(54) INKJET PRINTER

(75) Inventor: Ling-Peng Tang, Hunan (CN)

(73) Assignees: Silitek Electronic (GZ) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 874 days.

(21) Appl. No.: 12/314,795

(22) Filed: Dec. 17, 2008

(65) Prior Publication Data

US 2010/0097414 A1 Apr. 22, 2010

(30) Foreign Application Priority Data

Oct. 16, 2008 (CN) ..... 2008 1 0218469

(51) Int. Cl.
*B41J 25/308* (2006.01)
*B41J 11/20* (2006.01)

(52) U.S. Cl. ..... 347/8; 400/55

(58) Field of Classification Search ..... 347/8
See application file for complete search history.

(56) References Cited

U.S. PATENT DOCUMENTS

2003/0039500 A1* 2/2003 Kelley et al. ..... 400/59

FOREIGN PATENT DOCUMENTS

CN 101204889 A 6/2008
TW 491188 U 6/2002

* cited by examiner

*Primary Examiner* — Uyen Chau N Le
*Assistant Examiner* — Kajli Prince
(74) *Attorney, Agent, or Firm* — Rosenberg, Klein & Lee

(57) ABSTRACT

An inkjet printer with a frame and a printhead module further includes an adjusting piece and a pair of adjusting units, for adjusting a distance between the printhead module and a printing medium. An indicating portion and a scale portion are further disposed on the adjusting unit to indicate up-and-down moving amplitude of the adjusting piece. Thereby, the up-and-down moving amplitude of the printhead module is quantized, and the adjustment of the distance between the printhead module and the printing medium is precisely controlled.

10 Claims, 3 Drawing Sheets

INKJET PRINTER

CROSS-REFERENCE TO RELATED APPLICATIONS

This non-provisional application claims priority under 35 U.S.C. §119(a) on Patent Application No(s). 200810218469.7 filed in China, P.R.C. on Oct. 16, 2008 the entire contents of which are hereby incorporated by reference.

BACKGROUND OF THE INVENTION

1. Field of Invention

The present invention relates to an inkjet printer, and more particularly to an inkjet printer capable of adjusting the distance between a printhead module and a printing medium.

2. Related Art

Generally, an inkjet printer jets ink onto a printing medium to print a picture. The distance between a printhead module and the printing medium should be kept at a constant level, so as to optimize the printing quality. When the above distance becomes smaller, the ink jet range is shortened, and the jetted ink spots (i.e., pixels) are getting smaller and denser. Thereby, a greater number of pixels can be printed on the same area, and a better picture quality is achieved. On the contrary, if the distance is enlarged, the printed pixels become smaller. When the distance gets too large, the shape of the pixel is deformed, and the quality of the printed picture will be degraded. Likewise, if the distance is too small, the printing quality may also be affected. For example, if the printhead module gets too close to the printing medium, the wet ink on the printing medium may be passed on to the printhead module, and especially when moving back and forth, the printhead module again applies the ink onto the printing medium, thus seriously affecting the printing effect.

Recently, the distance between the printhead module and the printing medium in the inject printer is mainly adjusted by an assembly engineer during the printer assembly process according to experience. The engineer first uplifts the printhead module to a certain height with a jig, then confirms that the distance between the printhead module and the printing medium is reasonable after several times of debugging and inspection, and finally fixes the printhead module. During the debugging and inspection process, as the distance between the printhead module and the printing medium is mainly controlled by the assembly engineer according to experience, the accuracy is low and the debugging requires a lot of time and effort.

In Taiwan Patent No. 491188, a technical solution of adjusting the distance between the printhead module and the printing medium is disclosed. A carrier platform for carrying the printing medium serves as an adjusting object, i.e., the printing medium moves up and down with the carrier platform, so as to adjust the distance. However, this adjusting manner changes the medium path, and thus potential problems may occur during the movement of the medium in the printer, for example, the paper may be easily jammed during the printing process.

In addition, some other technical solutions are also provided to solve the problem of the distance between the printhead module and the printing medium during the printing process of the inkjet printer. For example, in PRC Patent No. 200710160332 disclosed on Jun. 25, 2008, an inkjet printing device and a method thereof are disclosed to achieve a constant distance between the printhead module and the printing medium by adjusting the height of the printhead module. However, this adjusting manner is complicated and of a high cost.

Therefore, it is in urgent need of a technical solution simple in structure, low in cost, and capable of effectively adjusting the distance between the printhead module and the printing medium, so as to improve the printing quality.

SUMMARY OF THE INVENTION

Accordingly, the present invention is directed to an inkjet printer simple in structure, low in cost, and capable of effectively adjusting the distance between a printhead module and a printing medium.

In order to achieve the above objective, an inkjet printer adapted for adjusting a distance between a printhead module and a printing medium is provided. The printhead module is carried by an adjusting piece mounted on a frame. The inkjet printer further includes a pair of adjusting units. Each adjusting unit has a pair of mutually hinged adjusting levers, a pair of connecting members, and an adjusting screw. The pair of adjusting levers are respectively fitted on a pair of pivots on the frame. The pair of connecting members are respectively connected to the adjusting piece and a stressing end of each adjusting lever that away from a hinged position of the adjusting levers. The adjusting screw is connected to an end of the adjusting lever that corresponding to the stressing end, and when the adjusting screw is selectively screwed, the stressing end of the pair of adjusting levers relatively moves up and down because of the pair of pivots. When the adjusting screw is screwed in, the end of the adjusting lever is pressed down, and the stressing end of the adjusting lever moves upwards according to the lever principle. Thereby, the adjusting piece is lifted and carries the printhead module to move upwards together, such that the distance between the printhead module and the printing medium is increased. On the contrary, when screwed out, the adjusting screw drives the end of the adjusting lever to move upwards, and correspondingly the stressing end of the adjusting lever moves downwards. Meanwhile, the adjusting piece moves downwards under the gravity effect, and the printhead module carried thereon also descends accordingly, such that the distance between the printhead module and the printing medium is reduced.

Selectively, an inkjet printer adapted for adjusting a distance between a printhead module and a printing medium is also provided. The printhead module is carried by an adjusting piece mounted on a frame. The inkjet printer further includes a pair of adjusting units. Each adjusting unit has a pair of mutually hinged adjusting levers, a pair of connecting members, and an adjusting screw. The pair of adjusting levers are respectively fitted on a pair of pivots on the frame. The pair of connecting members are respectively connected to the adjusting piece and a stressing end of each adjusting lever that away from a hinged position of the adjusting levers. The adjusting screw is disposed to rest on an end of the adjusting lever that corresponding to the stressing end, and when the adjusting screw is screwed in, the end of the pair of adjusting levers is pushed to move downwards. When the end of the adjusting lever moves downwards, the stressing end of the adjusting lever moves upwards according to the lever principle. Thereby, the adjusting piece is lifted and carries the printhead module to move upwards together, such that the distance between the printhead module and the printing medium is increased. On the contrary, when screwed out, the adjusting screw moves upwards to reduce the thrust applied to the end of the adjusting lever, and correspondingly the stressing end of the adjusting lever moves downwards under the gravity effect. Meanwhile, the adjusting piece also descends under the gravity effect, and the printhead module carried thereon moves downwards accordingly, such that the distance between the printhead module and the printing medium is reduced.

Moreover, the adjusting piece has an indicating portion, the frame has a scale portion, and the indicating portion is aligned with the scale portion to indicate up-and-down moving amplitude of the adjusting piece. Further, the scale portion is formed by etching, and a minimum scale of the scale portion is 0.1 mm.

Preferably, the ends of the pair of adjusting levers are hinged by a rivet.

Preferably, a fastening screw is disposed on the frame to fix the adjusting piece. In particular, the adjusting piece has an elongated through hole in a perpendicular direction corresponding to the combined position where the adjusting piece and the frame are joined by the fastening screw, and the fastening screw passes through the elongated through hole to fix the adjusting piece to the frame, so as to reserve a certain space for the adjusting piece to move up and down.

In the present invention, the distance between the printhead module and the printing medium is adjusted by using a mechanical structure composed of elements such as the adjusting piece, adjusting screw, and adjusting lever, and the structure is simple and low in cost. Moreover, the indicating portion and the scale portion are disposed to indicate the up-and-down moving amplitude of the adjusting piece. Thereby, the up-and-down moving amplitude of the printhead module is quantized, and the adjustment of the distance between the printhead module and the printing medium is precisely controlled.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
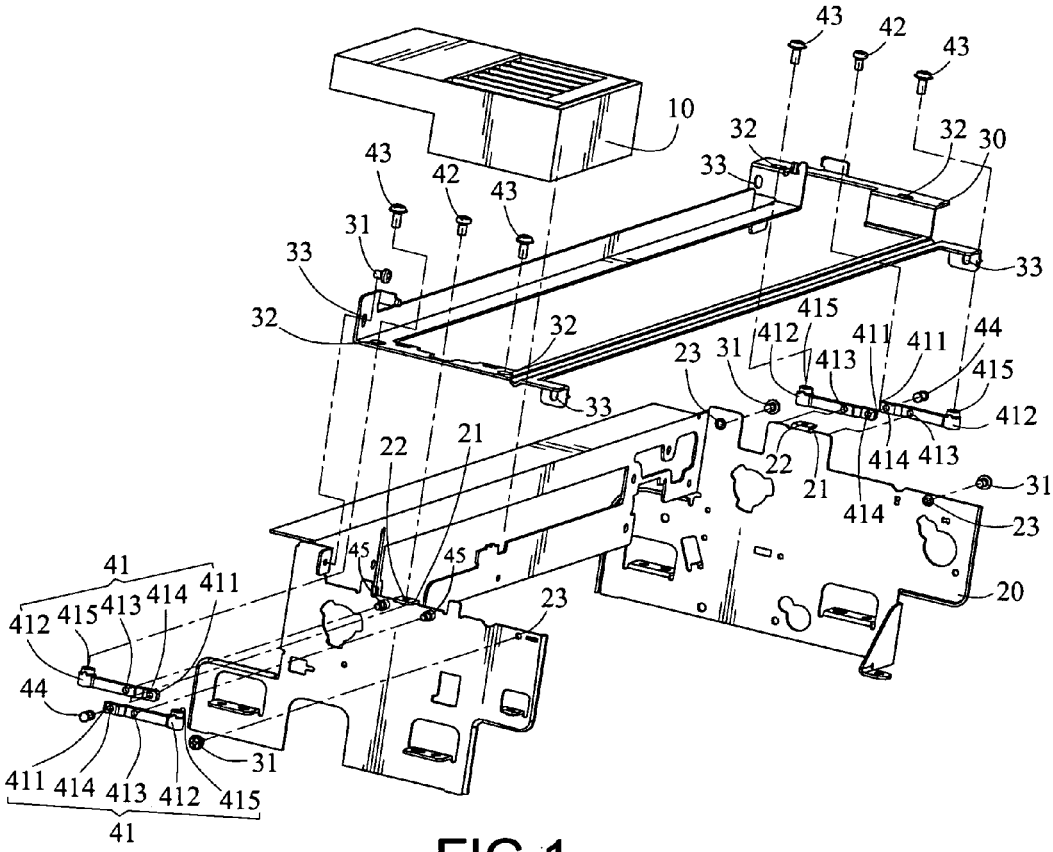
FIG. 1 is an exploded view showing the main structure of an inkjet printer according to an embodiment of the present invention.

Referring to FIG. 1, an inkjet printer of this embodiment includes a printhead module 10, a frame 20, an adjusting piece 30, and a pair of adjusting units symmetrically disposed on the left and right sides of the frame 20. Each adjusting unit includes a pair of adjusting levers 41, a pair of connecting members 43, and an adjusting screw 42.

Figure 2:
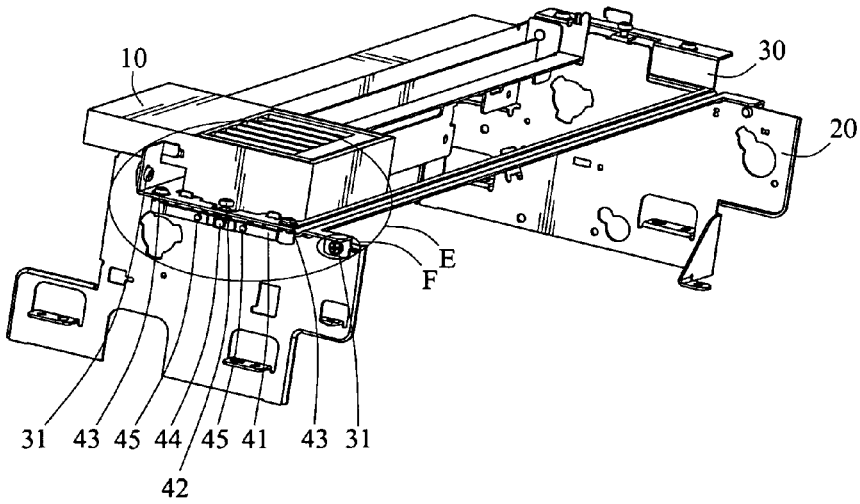
FIG. 2 is a schematic assembly view showing the main structure of the inkjet printer according to the embodiment of the present invention.
Figure 3:
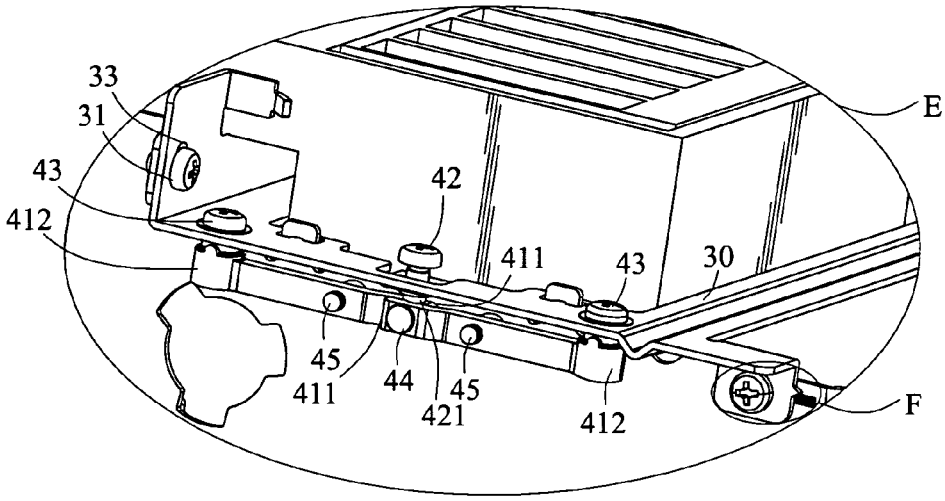
FIG. 3 is a schematic enlarged view of a part E in FIG. 2, in which a detailed structure of an adjusting unit is shown.

Referring to FIGS. 1, 2, and 3, the adjusting piece 30 is mounted on the frame 20 to carry the printhead module 10. A pair of adjusting levers 41, a pair of connecting members 43, and an adjusting screw 42 are symmetrically disposed on the left and right sides of the frame 20.

The pair of adjusting levers 41 are respectively fitted on a pivot 45 extending from the frame 20 through a first through hole 413. An end 411 of each adjusting lever 41 has a second through hole 414, and a rivet 44 passes through the second through holes 414 to join the ends 411 of the pair of adjusting levers 41 together, thus forming a hinge joint. A stressing end 412 of each adjusting lever 41 extends in a different direction, and has a third through hole 415 with an opening direction perpendicular to those of the first through hole 413 and the second through hole 414.

In this embodiment, the connecting member 43 is a screw of a certain length. The connecting member 43 passes through the third through hole 415 on the stressing end 412 of the adjusting lever 41 and a fourth through hole 32 on the adjusting piece 30, so as to connect the stressing end 412 of the adjusting lever 41 and the adjusting piece 30. After joining, the adjusting piece 30 is located above the adjusting lever 41, and is supported by the stressing end 412. In this manner, the adjusting piece 30 moves up and down together with the stressing end 412, thus achieving the purpose of relatively adjusting the distance between the printhead module and the printing medium.

In particular, the adjusting screw 42 passes through the adjusting piece 30 to match with a screw hole 22 on a support piece 21 extending from the frame 20, and a lower end 421 of the adjusting screw 42 rests on the end 411 of the adjusting lever 41 that corresponding to the stressing end 412. Thereby, through the hinge joint of the pair of adjusting levers 41 (realized by letting the rivet 44 pass through the second through holes 414 of the pair of adjusting levers 41) and the pivots of the pair of adjusting levers 41 (realized by respectively fitting the first through holes 413 of the pair of adjusting levers 41 on the pivots 45), the stressing end 412 of the adjusting lever 41 is made to relatively move upwards when a force is applied to the end 411 of the adjusting lever 41 by tightening the adjusting screw 42 according to the lever principle. In this manner, the adjusting piece 30 is lifted and carries the printhead module 10 to move upwards together, such that the distance between the printhead module and the printing medium is increased. On the contrary, when the adjusting screw 42 is loosened, the thrust applied to the end 411 of the adjusting lever 411 is reduced with the lifting of the adjusting screw 42, and the stressing end 412 of the adjusting lever 41 relatively moves downwards under the weight of the adjusting piece 30 and the printhead module 10 carried thereon. Meanwhile, the printhead module 10 also moves downwards accordingly, such that the distance between the printhead module 10 and the printing medium is reduced.

Figure 5:
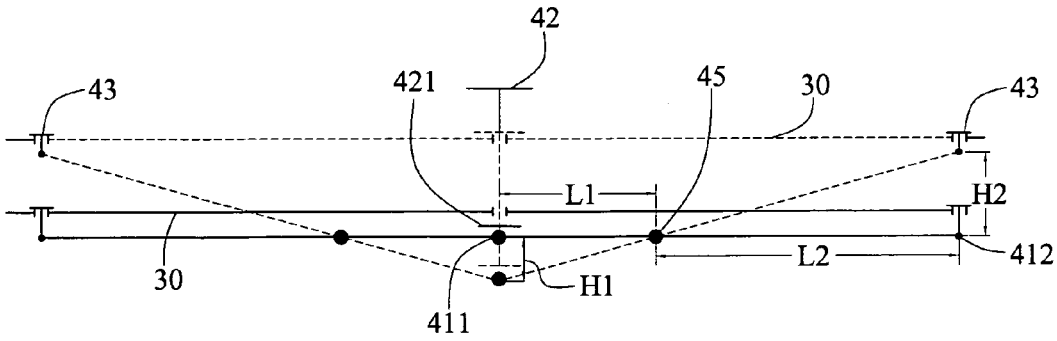
FIG. 5 is a schematic view illustrating an adjusting principle of the adjusting unit in the inkjet printer according to the embodiment of the present invention.

FIG. 5 is a schematic view illustrating an adjusting principle of the adjusting unit. In FIG. 5, solid lines show a non-screwed-in state of the adjusting screw 42. In this state, the adjusting unit is balanced under the effects of a pivot supporting force and the gravity, and the adjusting lever 41 is basically in a level condition, such that the distance between the printhead module 10 and the printing medium is the minimum. On the contrary, when the adjusting screw 42 starts to be screwed in, as the end 411 of the adjusting lever 41 moves downwards, the stressing end 412 relatively moves upwards according to the lever principle. Seen from FIG. 5, according to the side length relationship of diagonal triangles, a ratio between an upward moving height H2 of the stressing end 412 (i.e., a lifted height of the printhead module 10) and a screwed-in depth H1 of the adjusting screw 42 is equal to a ratio between a distance L2 from the stressing end 412 of the adjusting lever to the pivot 45 and a distance L1 from the end 411 to the pivot 45. In theory, a maximum screwed-in depth of the adjusting screw 42 is the length of the thread region, and a maximum lifted height of the printhead module 10 is L2/L1 times of the length of the thread region of the adjusting screw 42.

Selectively, the lower end of the adjusting screw 42 may be connected to the end 411 of the adjusting lever or connected to the rivet 44 hinging the end 411. When the adjusting screw 42 is screwed in, the end 411 of the adjusting lever 41 is pressed down, and the stressing end 412 of the adjusting lever 41 moves upwards according to the lever principle. Thereby, the adjusting piece 30 is lifted and carries the printhead module 10 to move upwards together, such that the distance between the printhead module 10 and the printing medium is increased. On the contrary, when screwed out, the adjusting screw 42 drives the end 411 of the adjusting lever 41 to move upwards, and correspondingly the stressing end 412 of the adjusting lever 41 moves downwards. Meanwhile, the adjusting piece 30 moves downwards under the gravity effect, and the printhead module 10 carried thereon also descends accordingly, such that the distance between the printhead module 10 and the printing medium is reduced.

Figure 6:
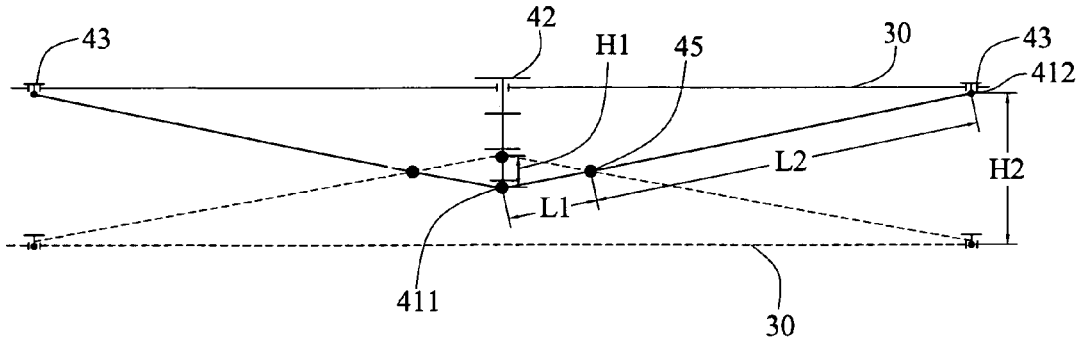
FIG. 6 is a schematic view illustrating an adjusting principle of the adjusting unit in the inkjet printer according to another preferred embodiment of the present invention, in which a maximum up-and-down moving range of the adjusting piece is shown.

Referring to FIG. 6, when the lower end 421 of the adjusting screw 42 is connected to the end 411 of the adjusting lever 41, the adjusting screw 42 is screwed in or out to drive the end 411 of the adjusting lever 41 to move downwards or upwards, so as to lift or lower the adjusting piece. In this manner, the printhead module 10 is made to move upwards or downwards, such that the distance between the printhead module 10 and the printing medium is increased or reduced accordingly. FIG. 6 shows states when the adjusting screw 42 is screwed in to a maximum depth (represented by solid lines) and screwed out to a maximum height (represented by dashed lines). Between the two states, the up-and-down moving distance H1 of the adjusting screw 42 is the length of the thread region. According to the side length relationship of diagonal triangles, a ratio between the up-and-down moving height range H2 (i.e., the adjusted height range of the printhead module 10) of the stressing end 412 and H1 is equal to a ratio between L2 (the distance from the stressing end 412 of the adjusting lever to the pivot 45) and L1 (the distance from the end 411 of the adjusting lever to the pivot 45). In theory, the adjusted height range of the printhead module 10 is L2/L1 times of the length of the thread region of the adjusting screw 42.

Preferably, a fifth through hole 33 is respectively disposed on four corners of the adjusting piece 30, and a second screw hole 23 is respectively disposed on positions of the frame 20 corresponding to the four corners of the adjusting piece 30. In this manner, a fastening screw 31 passes through the fifth through hole 33 and is screwed in the second screw hole 23, so as to more stably fix the adjusting piece 30 to the frame 20. The fifth through hole 33 is formed in the shape of an elongated slot in a perpendicular direction, and thus a certain space is reserved for the adjusting piece 30 to move up and down.

Figure 4:
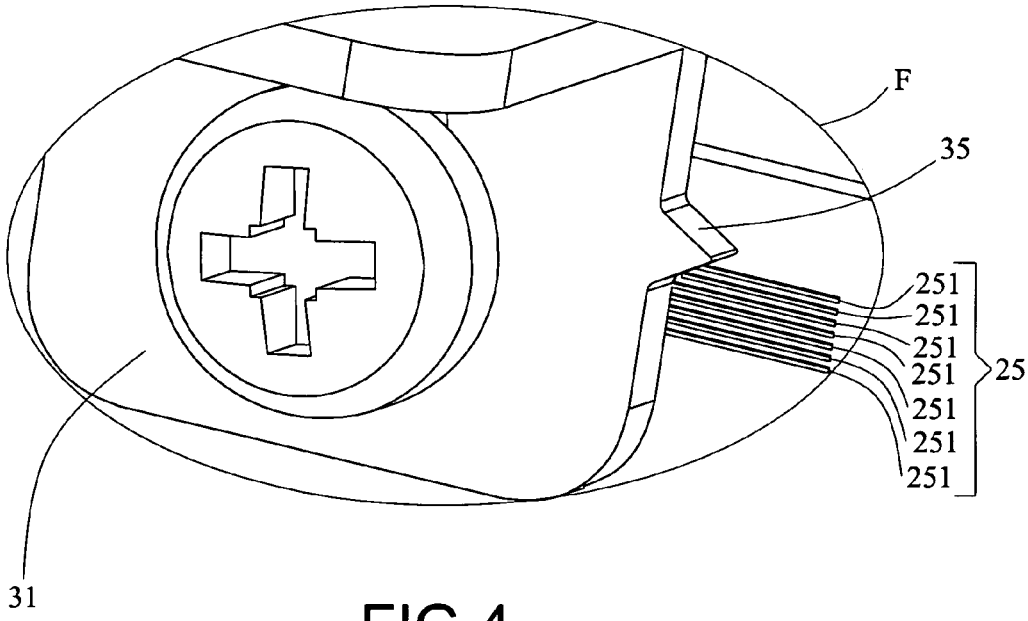
FIG. 4 is a schematic enlarged view of a part F in FIG. 2, in which detailed structures of an indicating portion and a scale portion are shown.

Referring to FIG. 4, in order to control the up-and-down moving distance of the printhead module 10, i.e., to adjust the distance between the printhead module and the printing medium, an indicating portion 35 is disposed on the adjusting piece 30, and a scale portion 25 is relatively disposed on the frame 20 to clearly indicate the relatively moving distance of the printhead module 10. The indicating portion 35 is a protruding sharp corner aligned with the scale portion 25. The scale portion 25 is preferably formed by etching, and has a minimum scale of 0.1 mm, i.e., a distance between two adjacent scale lines 251 is 0.1 mm. In this manner, the indicating portion 35 moves up and down together with the adjusting piece 30, such that the indicating portion 35 may indicate the up-and-down moving amplitude of the adjusting piece 30, i.e., a specified up-and-down moving distance of the printhead module. Therefore, the distance between the printhead module and the printing medium is precisely controlled.

In a common inkjet printer, the distance between the printhead module and the printing medium is arranged within a range of 1.5±0.5 mm to meet the basic printing demand. In this embodiment, the set minimum scale is 0.1 mm, such that not only the basic demand is satisfied, but the distance may be further precisely adjusted to enhance the printing quality.

In the present invention, the distance between the printhead module and the printing medium is adjusted by using a mechanical structure composed of elements such as the adjusting piece, adjusting screw, and adjusting lever, and the structure is simple and low in cost. Moreover, the indicating portion and the scale portion are disposed to indicate the up-and-down moving amplitude of the adjusting piece. Thereby, the up-and-down moving amplitude of the printhead module is quantized, and the adjustment of the distance between the printhead module and the printing medium is precisely controlled.

What is claimed is:

1. An inkjet printer, adapted for adjusting a distance between a printhead module and a printing medium, wherein the printhead module is carried by an adjusting piece mounted on a frame, the inkjet printer further comprising a pair of adjusting units, wherein each adjusting unit has a pair of mutually hinged adjusting levers, a pair of connecting members, and an adjusting screw; the pair of adjusting levers are respectively fitted on a pair of pivots on the frame; the pair of connecting members are respectively connected to the adjusting piece and a stressing end of each adjusting lever that is away from a hinged position of the adjusting levers; the adjusting screw is connected to an end of the adjusting lever that corresponding to the stressing end, and when the adjusting screw is selectively screwed, the stressing end of the pair of adjusting levers relatively moves up and down because of the pair of pivots.

2. An inkjet printer, adapted for adjusting a distance between a printhead module and a printing medium, wherein the printhead module is carried by an adjusting piece mounted on a frame, the inkjet printer further comprising a pair of adjusting units, wherein each adjusting unit has a pair of mutually hinged adjusting levers, a pair of connecting members, and an adjusting screw; the pair of adjusting levers are respectively fitted on a pair of pivots on the frame; the pair of connecting members are respectively connected to the adjusting piece and a stressing end of each adjusting lever that is away from the a hinged position of the adjusting levers; the adjusting screw is disposed to rest on an end of the adjusting lever that corresponding to the stressing end, and when the adjusting screw is screwed in, the end of the pair of adjusting levers is pushed to move downwards.

3. The inkjet printer according to claim 1 or 2, wherein the adjusting piece has an indicating portion, the frame has a scale portion, and the indicating portion is aligned with the scale portion to indicate up-and-down moving amplitude of the adjusting piece.

4. The inkjet printer according to claim 3, wherein the scale portion is formed by etching.

5. The inkjet printer according to claim 3, wherein a minimum scale of the scale portion is 0.1 mm.

6. The inkjet printer according to claim 1 or 2, wherein the ends of the pair of adjusting levers are hinged by a rivet.

7. The inkjet printer according to claim 1 or 2, wherein a fastening screw is disposed on the frame to fix the adjusting piece.

8. The inkjet printer according to claim 7, wherein the adjusting piece has an elongated through hole in a perpendicular direction corresponding to the combined position where the adjusting piece and the frame are joined by the fastening screw, and the fastening screw passes through the elongated through hole to fix the adjusting piece to the frame.

9. The inkjet printer according to claim 1, wherein a ratio between an adjusted height range of the printhead module and a distance from a maximum screwed-in depth to a maximum screwed-out height of the adjusting screw is equal to a ratio between a distance from the stressing end of the adjusting lever to the pivot and a distance from the end to the pivot.

10. The inkjet printer according to claim 2, wherein a ratio between an adjusted height of the printhead module and a screwed-in depth of the adjusting screw is equal to a ratio between a distance from the stressing end of the adjusting lever to the pivot and a distance from the end to the pivot.

* * * * *